US006030765A

United States Patent [19]

Leenders et al.

[11] Patent Number: 6,030,765

[45] Date of Patent: Feb. 29, 2000

[54] THERMOGRAPHIC RECORDING MATERIAL COATABLE WITH IMPROVED STABILITY

[75] Inventors: Luc Leenders, Herentals; Jan Gilleir, Mortsel; Ivan Hoogmartens, Wilrijk, all of Belgium

[73] Assignee: Agfa-Gevaert, Mortsel, Belgium

[21] Appl. No.: 09/120,537

[22] Filed: Jul. 22, 1998

Related U.S. Application Data

[60] Provisional application No. 60/069,215, Dec. 11, 1997.

[30] Foreign Application Priority Data

Sep. 17, 1997 [EP] European Pat. Off. ..... 97202876

[51] Int. Cl.[7] ..... G03C 1/498

[52] U.S. Cl. ..... 430/617; 430/531; 430/607

[58] Field of Search ..... 430/617, 546, 430/607, 531, 138

[56] References Cited

U.S. PATENT DOCUMENTS 3,476,937 11/1969 Vrancken .

FOREIGN PATENT DOCUMENTS 0736799 3/1969 European Pat. Off. .

*Primary Examiner*—Thorl Chea
*Attorney, Agent, or Firm*—Baker & Botts, L.L.P.

[57] ABSTRACT

A recording material including a support and a thermosensitive element comprising a substantially light-insensitive organic silver salt, an organic reducing agent therefor in thermal working relationship therewith, a hydrophobic polymer, a binder and optionally photosensitive silver halide in catalytic association with the substantially light insensitive organic silver salt, wherein the thermosensitive element includes a non-heat-responsive separate organic phase containing the hydrophobic polymer and the organic reducing agent; a process for producing the recording material; and a (photo)thermographic recording process therefor.

24 Claims, No Drawings

THERMOGRAPHIC RECORDING MATERIAL COATABLE WITH IMPROVED STABILITY

The application claims the benefit of U.S. Provisional Application No. 60/069,215 filed Dec. 11, 1997.

FIELD OF THE INVENTION

The present invention relates to a substantially light-insensitive thermographic material including discrete hydrophobic particles comprising a hydrophobic polymer and an organic reducing agent.

BACKGROUND OF THE INVENTION

Thermal imaging or thermography is a recording process wherein images are generated by the use of thermal energy.

In thermography three approaches are known:

1. Direct thermal formation of a visible image pattern by image-wise heating of a recording material containing matter that by chemical or physical process changes colour or optical density.

2. Image-wise transfer of an ingredient necessary for the chemical or physical process bringing about changes in colour or optical density to a receptor element.

3. Thermal dye transfer printing wherein a visible image pattern is formed by transfer of a coloured species from an image-wise heated donor element onto a receptor element.

Thermographic materials of type 1 become photothermographic upon incorporating a photosensitive agent which after exposure to UV, visible or IR light is capable of catalyzing or participating in a thermographic process bringing about changes in colour or optical density.

WO 94/16361 discloses a multilayer heat-sensitive material which comprises: a color-forming layer comprising: a color-forming amount of finely divided, solid colorless noble metal or iron salt of an organic acid distributed in a carrier composition; a color-developing amount of a cyclic or aromatic organic reducing agent, which at thermal copy and printing temperatures is capable of a color-forming reaction with the noble metal or iron salt; and an image-toning agent; characterized in that (a) the carrier composition comprises a substantially water-soluble polymeric carrier and a dispersing agent for the noble metal or iron salt and (b) the material comprises a protective overcoating layer for the color-forming layer.

WO 97/04355 discloses a photothermographic recording material comprising a support and a photo-addressable thermally developable element comprising photosensitive silver halide in catalytic association with a substantially light-insensitive silver salt of an organic carboxylic acid, an organic reducing agent for said substantially light-insensitive silver salt of an organic carboxylic acid in thermal working relationship therewith and a binder, characterized in that said binder, comprises a non-proteinaceous water-soluble binder, a non-proteinaceous water-dispersible binder or a mixture of a non-proteinaceous water-soluble binder and a non-proteinaceous water-dispersible binder.

U.S. Pat. No. 4,708,928 discloses a photothermographic active particle having dimensions between 0.5 and 100 microns comprising a transparent binder, photosensitive silver halide, light insensitive silver compound, and a reducing agent for silver ion.

EP-A 736 799 discloses a recording material comprising a support having provided thereon at least a recording layer comprising (a) a heat-responsive microcapsule having encapsulated therein an organic silver salt, (b) a developer for the organic silver salt and (c) a water-soluble binder.

The inventors of the present invention found that thermographic and photothermographic recording materials coated from aqueous media using the teachings of U.S. Pat. No. 4,708,928 and EP-A 736 799 with reducing agent in close proximity to the organic silver salt in particles or microcapsules exhibited poor archivability and poor light stability.

The poor archivability and poor light stability of thermographic and photothermographic recording materials coated from aqueous media is a general problem and has led to most commercial thermographic and photothermographic materials being coated from solvent media despite the obvious economic and environmental disadvantages thereof. There is therefore a need for thermographic and photothermographic recording materials coatable from aqueous media which exhibit comparable or better stability than recording materials coated from solvent media.

OBJECTS OF THE INVENTION

It is therefore an object of the present invention to provide thermographic and photothermographic materials which exhibit improved archivability and/or improved light stability, while maintaining high $D_{max}$ and low $D_{min}$ levels upon printing.

It is a further object of the present invention to provide thermographic and photothermographic materials coated from aqueous media which exhibit improved archivability and/or improved light stability, while maintaining high $D_{max}$ and low $D_{min}$ levels upon printing.

Further objects and advantages of the invention will become apparent from the description hereinafter.

SUMMARY OF THE INVENTION

Surprisingly it has been found that thermosensitive elements incorporating an organic reducing agent and a hydrophobic polymer in a non-heat-responsive separate organic phase, particles of substantially light-insensitive organic silver salt particles and a binder exhibit a substantial improvement in archivability and light stability, while not exhibiting the expected substantial increase in thermal development energy requirement due to the increased physical separation of the organic reducing agent from the particles of organic silver salt.

A recording material is provided, according to the present invention, including a support and a thermosensitive element comprising a substantially light-insensitive organic silver salt, an organic reducing agent therefor in thermal working relationship therewith, a hydrophobic polymer and a binder, wherein the thermosensitive element includes a non-heat-responsive separate organic phase containing the hydrophobic polymer and the organic reducing agent.

A process is also provided, according to the present invention, for producing the above-referred to recording material comprising the steps of: producing a dispersion of discrete organic hydrophobic particles containing the hydrophobic polymer and the organic reducing agent; preparing aqueous dispersions or solutions together containing the substantially light-insensitive organic silver salt, the binder and the discrete organic hydrophobic particles; and coating the dispersions or solutions onto the support to form one or more layers making up the thermosensitive element.

A thermographic recording process is further provided, according to the present invention, comprising the steps of: (i) bringing an outermost layer of the above-referred to recording material into proximity with a heat source; (ii) applying heat from the heat source image-wise heating to the recording material while maintaining proximity to the heat source to produce an image; and (iii) removing the recording material from the heat source.

A photothermographic recording process comprising the steps of: (i) image-wise exposing the-above-referred to recording material to a source of actinic radiation; (ii) uniformly applying heat from a heat source to the recording material; and (iii) removing the recording material from the heat source.

Preferred embodiments of the present invention are disclosed in the detailed description of the invention.

DETAILED DESCRIPTION OF THE INVENTION

Substantially

By substantially light-insensitive is meant not intentionally light sensitive.

Non-Heat-Responsive Separate Organic Phase

The non-heat-responsive separate organic phase present in the recording materials of the present invention consists essentially of organic ingredients, although small quantities of metal-ion containing surfactants and sufficiently small quantities of organic silver salts not to adversely affect the stability of the recording material of the present invention may also be present. The term organic ingredients includes for the purposes of the present invention compounds consisting of carbon and one or more of the following elements: hydrogen, boron, silicon, nitrogen, phosphorus, oxygen, sulphur, selenium, tellurium, fluorine, chlorine, bromine and iodine. The term non-heat-responsive means of itself not heat responsive.

The separate phase may be the continuous phase in which the organic silver salt particles and binder are dispersed or discrete organic hydrophobic particles. The surface of the separate phase may be hydrophilic, but its bulk must be hydrophobic. The hydrophobic bulk of the separate phase preferably corresponds to at least 80% by volume and particularly preferably to at least 90% by volume of the separate phase.

It is preferred that hydrophilic binders, should they be present, be only present at or near the surface of the separate phase where they perform the role of dispersion agents. The choice of hydrophobic polymer for the particles is uncritical except that diffusion of the organic reducing agent to the particles of substantially light-insensitive organic silver salt must not be unduly hindered during the thermal development process.

Should the separate phase in the recording material of the present invention be present as discrete organic hydrophobic particles then they preferably have a diameter between about 0.1 $\mu$m and about 100 $\mu$m.

The discrete organic hydrophobic particles containing the hydrophobic polymer and the organic reducing agent used in the production process may be produced by any technique which does not adversely affect the thermographic or photothermographic properties of the recording materials e.g. melt mixing and grinding, dispersion of a solution or dispersion in an organic medium in water followed by evaporating off the organic medium, spray drying of a dispersion or a solution etc. Surfactants and dispersion agents may be used in the production of these organic hydrophobic particles.

Hydrophobic Polymer

Suitable hydrophobic polymers for use in the recording material of the present invention are hydrophobic natural, modified natural or synthetic resins in which the organic reducing agent can be dispersed or dissolved, for example: polyesters; polyurethanes; polycarbonates; after-chlorinated polyvinyl chloride; polyvinyl acetals e.g. polyvinyl butyral; polymers and copolymers of acrylic acid esters, vinyl chloride, vinylidene chloride, vinyl esters, acrylonitrile, acrylamide, methacrylamide, methacrylic acid esters, styrene, dienes e.g. butadiene, isoprene etc., etc.

The hydrophobic polymer used in the recording materials of the present invention is preferably polyvinyl butyral.

Such hydrophobic polymers may be used in conjunction with plasticizers, waxes or "heat solvents" also called "thermal solvents" or thermosolvents" to improved the rate of diffusion of the organic reducing agent to the particles of organic silver salt at elevated temperatures during the thermal development process.

Thermosensitive Element

According to the present invention, a recording material is provided comprising a thermosensitive element comprising a substantially light-insensitive organic silver salt, an organic reducing agent therefor in thermal working relationship therewith, a hydrophobic polymer and a binder, characterized in that the thermosensitive element includes a non-heat-responsive separate phase containing the hydrophobic polymer and the organic reducing agent. The thermosensitive element may further comprise photosensitive silver halide in catalytic association with the organic silver salt, whereupon it becomes a photo-addressable thermally developable element.

The thermosensitive or photo-addressable thermally developable element may comprise a layer system in which the ingredients are dispersed in different layers, with the proviso that the substantially light-insensitive organic silver salt and the organic reducing agent are in thermal working relationship with one another i.e. during the thermal development process the organic reducing agent must be present in such a way that it is able to diffuse to the substantially light-insensitive organic silver salt particles so that reduction of the organic silver salt can take place. The thickness of the thermosensitive or photo-addressable thermally Edevelopable element is preferably in the range of 1 to 50 $\mu$m.

Production Process for the Thermosensitive or Photo-Addressable Thermally Developable Element The thermosensitive or photo-addressable thermally developable element of the recording materials of the present invention can be coated from any medium which does not affect the discreteness of the organic hydrophobic particles, but aqueous media are preferred. Any binders may be used for the thermosensitive or photo-addressable thermally developable element provided that at least one of which is film-forming and they do not affect the discreteness of the organic hydrophobic particles, but water-soluble or water-dispersible binders are preferred.

Aqueous

The term aqueous for the purposes of the present invention includes mixtures of water with water-miscible organic solvents such as alcohols e.g. methanol, ethanol, 2-propanol, butanol, iso-amyl alcohol etc.; glycols e.g. ethylene glycol; glycerine; N-methyl pyrrolidone; methoxypropanol; and ketones e.g. 2-propanone and 2-butanone etc.

Water-Soluble and Water-Dispersible Binders

Suitable water-soluble film-forming binders for use in the thermosensitive element are: polyvinyl alcohol, polyacrylamide, polyacrylic acid, polymethacrylic acid, polyvinylpyrrolidone, polyethyleneglycol, proteinaceous binders such as gelatin, modified gelatins such as phthaloyl gelatin, polysaccharides, such as starch, gum arabic and dextran and water-soluble cellulose derivatives.

Suitable water-dispersible binders for use in the thermosensitive element are any water-insoluble polymer e.g. water-insoluble cellulose derivatives, polyurethanes, polyesters, polycarbonates and polymers derived from α,β-ethylenically unsaturated compounds such as after-chlorinated polyvinyl chloride, partially hydrolyzed polyvinyl acetate, polyvinyl alcohol, polyvinyl acetals preferably polyvinyl butyral, and homopolymers and copolymers produced using monomers selected from the group consisting of: vinyl chloride, vinylidene chloride, acrylonitrile, acrylamides, methacrylamides, methacrylates, acrylates, methacrylic acids, acrylic acids, vinyl esters, styrenes, dienes and alkenes; or mixtures thereof. It should be noted that there is no clear cut transition between a polymer dispersion and a polymer solution in the case of very small polymer particles resulting in the smallest particles of the polymer being dissolved and those slightly larger being in dispersion. The use of polymer latexes is preferred.

Preferred water-dispersible binders for use in the recording materials of the present invention are polymers with covalently bonded ionic groups, with such polymers containing crosslinkable groups being particularly preferred. The use of gelatin is also preferred.

To improve the layer-forming properties of water-soluble and water-dispersible polymers, plasticizers can be incorporated into the polymers, water-miscible solvents can be added to the dispersion medium and mixtures of water-soluble polymers, mixtures of water-dispersible polymers, or mixtures of water-soluble and water-dispersible polymers may be used.

Thermal Solvents

The above mentioned binders or mixtures thereof may be used in conjunction with waxes or "heat solvents" also called "thermal solvents" or "thermosolvents" improving the reaction speed of the redox-reaction at elevated temperature. By the term "heat solvent" in this invention is meant a non-hydrolyzable organic material which is in a solid state in the recording layer at temperatures below 50° C., but upon heating becomes a plasticizer for the recording layer and/or a liquid solvent for at least one of the redox-reactants.

Organic Silver Salts

Preferred substantially light-insensitive organic silver salts for use in the present invention are silver salts of organic carboxylic acids and in particular silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, which silver salts are also called "silver soaps". Silver salts of modified aliphatic carboxylic acids with thioether group as described e.g. in GB-P 1,111,492 and other silver salt of an organic carboxylic acids as described in GB-P 1,439,478, e.g. silver benzoate, may likewise be used to produce a thermally developable silver image. Combinations of different silver salts of organic carboxylic acids may also be used in the present invention. A process for producing a suspension of particles containing a substantially light-insensitive organic silver salt is disclosed in EP-A 754 969.

The weight ratio of binder used to organic silver salt used, according to the present invention, is preferably in the range of 0.2 to 6.

Organic Reducing Agents

Suitable organic reducing agents for the reduction of the substantially light-insensitive organic silver salts are organic compounds containing at least one active hydrogen atom linked to O, N or C, such as is the case with: catechol; hydroquinone; aminophenols; METOL™; p-phenylenediamines; alkoxynaphthols, e.g. 4-methoxy-1-naphthol described in U.S. Pat. No. 3,094,41; pyrazolidin-3-one type reducing agents, e.g. PHENIDONE™; pyrazolin-5-ones; indan-1,3-dione derivatives; hydroxytetrone acids; hydroxytetronimides; hydroxylamine derivatives such as for example described in U.S. Pat. No. 4,082,901; hydrazine derivatives; and reductones e.g. ascorbic acid; see also U.S. Pat. No. U.S. Pat. No. 3,074,809, U.S. Pat. No. 3,080,254, U.S. Pat. No. 3,094,417 and U.S. Pat. No. 3,887,378.

Polyphenols such as the bisphenols used in the previous 3M DRY SILVER™ materials and current IMATION DRY SILVER™ materials, sulfonamide phenols such as used in the KODAK DACOMATIC™ materials, and naphthols are particularly preferred for photothermographic materials on the basis of silver halide/organic silver salt/reducing agent.

Auxiliary Reducing Agents

The above mentioned organic reducing agents, regarded as primary or main reducing agents, may be used in conjunction with so-called auxiliary reducing agents. Such auxiliary reducing agents are e.g. sterically hindered phenols, such as described in U.S. Pat. No. 4,001,026; bisphenols, e.g. of the type described in U.S. Pat. No. 3,547,648; or sulfonamidophenols as described in Research Disclosure 17842 published in February 1979, U.S. Pat. No. 4,360,581, U.S. Pat. No. 4,782,004 and in EP-A 423 891. The auxiliary reducing agents may be present in the imaging layer or in a polymeric binder layer in thermal working relationship thereto.

Other auxiliary reducing agents that may be used in conjunction with the above mentioned primary reducing agents are hydrazides such as disclosed in EP-A 762 196, sulfonyl hydrazide reducing agents such as disclosed in U.S. Pat. No. 5,464,738; trityl hydrazides and formyl-phenyl-hydrazides such as disclosed in U.S. Pat. No. 5,496,695;

trityl hydrazides and formyl-phenyl-hydrazides with diverse auxiliary reducing agents such as disclosed in U.S. Pat. No. 5,545,505, U.S. Pat. No. 5,545,507 and U.S. Pat. No. 5,558,983; acrylonitrile compounds as disclosed in U.S. Pat. No. U.S. Pat. No. 5,545,515 and U.S. Pat. No. 5,635,339; 2-substituted malondialdehyde compounds as disclosed in U.S. Pat. No. 5,654,130; and organic reducing metal salts, e.g. stannous stearate described in U.S. Pat. No. 3,460,946 and U.S. Pat. No. 3,547,648.

Toning Agents

In order to obtain a neutral black image tone in the higher densities and neutral grey in the lower densities, thermographic recording materials according to the present invention may contain one or more toning agents. The toning agents should be in thermal working relationship with the substantially light-insensitive organic silver salt and organic reducing agents during thermal processing. Any known toning agent from thermography or photothermography may be used. Suitable toning agents are the phthalimides and phthalazinones within the scope of the general formulae described in U.S. Pat. No. 4,082,901 and the toning agents described in U.S. Pat. No. 3,074,809, U.S. Pat. No. 3,446,648 and U.S. Pat. No. 3,844,797. Particularly useful toning agents are the heterocyclic toner compounds of the benzoxazine dione or naphthoxazine dione type described in GB-P 1,439,478, U.S. Pat. No. 3,951,660 and U.S. Pat. No. 5,599,647.

Surfactants and Dispersants

Surfactants and dispersants aid the dispersion of ingredients which are insoluble in the particular dispersion medium. The thermographic recording materials of the present invention may contain one or more surfactants, which may be anionic, non-ionic or cationic surfactants and/or one or more dispersants.

Examples of suitable surfactants are:

Surfactant Nr. 1=HOSTAPAL™ B, a sodium trisalkylphenylpolyethyleneglycol(EO 7-8)sulphate from Hoechst;

Surfactant Nr. 2=MERSOLAT™ H80, a sodium hexadecylsulfonate from Bayer;

Surfactant Nr. 3=ULTRAVON™ W, a sodium arylsulfonate from Ciba-Geigy;

Surfactant Nr. 4=TERGITOL™ 4, a sodium 1-(2'-ethylbutyl)-4-ethylhexylsulphate;

Surfactant Nr. 5=MARLON™ A-396, a sodium dodecylphenylsulfonate from Hüls;

Surfactant Nr. 6=HOSTAPAL™ W, a nonylphenylpolyethyleneglycol from Hoechst.

Surfactant Nr. 7.=GAFAC™ RM710, a complex organic phosphate ester from Antara Chemie Suitable dispersants are natural polymeric substances, synthetic polymeric substances and finely divided powders, for example finely divided non-metallic inorganic powders such as silica.

Stabilizers and Antifoggants

In order to obtain improved shelf-life and reduced fogging, stabilizers and antifoggants may be incorporated into the thermographic and photothermographic materials of the present invention. Examples of suitable stabilizers and antifoggants and their precursors, which can be used alone or in combination, include the thiazolium salts described in U.S. Pat. No. 2,131,038 and U.S. Pat. No. 2,694,716; the azaindenes described in U.S. Pat. No. 2,886,437 and U.S. Pat. No. 2,444,605; the urazoles described in U.S. Pat. No. 3,287,135; the sulfocatechols described in U.S. Pat. No. 3,235,652; the oximes described in GB-P 623,448; the thiuronium salts described in U.S. Pat. No. 3,220,839; the palladium, platinum and gold salts described in U.S. Pat. No. 2,566,263 and U.S. Pat. No. 2,597,915; the tetrazolyl-thio-compounds described in U.S. Pat. No. 3,700,457; the mesoionic 1,2,4-triazolium-3-thiolate stabilizer precursors described in U.S. Pat. No. 4,404,390 and U.S. Pat. No. 4,351,896; the tribromomethyl ketone compounds described in EP-A 600 587; the combination of isocyanate and halogenated compounds described in EP-A 600 586; the vinyl sulfone and β-halo sulfone compounds described in EP-A 600 589; and those compounds mentioned in this context in Chapter 9 of "Imaging Processes and Materials, Neblette's 8th edition", by D. Kloosterboer, edited by J. Sturge, V. Walworth and A. Shepp, page 279, Van Nostrand (1989); in Research Disclosure 17029 published in June 1978; and in the references cited in all these documents.

The separate organic phase used in the present invention preferably further contains a stabilizing agent.

Other Ingredients

In addition to said ingredients the thermographic and photothermographic materials of the present invention may contain other additives such as free fatty acids, silicone oil, ultraviolet light absorbing compounds, white light reflecting and/or ultraviolet radiation reflecting pigments, silica, and/or optical brightening agents.

Support

The support for the thermographic and photothermographic materials according to the present invention may be transparent, translucent or opaque and is preferably a thin flexible carrier made e.g. from paper, polyethylene coated paper or transparent resin film, e.g. made of a cellulose ester, e.g. cellulose triacetate, polypropylene, polycarbonate or polyester, e.g. polyethylene terephthalate. The support may be in sheet, ribbon or web form and subbed if needs be to improve the adherence to the thereon coated heat-sensitive recording layer. The support may be made of an opacified resin composition.

Protective Layer

The thermosensitive element used in the recording materials of the present invention may also be provided with a protective layer.

In general this protects the thermosensitive or photoaddressable thermally developable element from atmospheric humidity and from surface damage by scratching etc. and prevents direct contact of printheads or heat sources with said recording layers. Protective layers for thermosensitive elements which come into contact with and have to be transported past a heat source under pressure, have to exhibit resistance to local deformation and good slipping characteristics during transport past the heat source during heating.

The protective layer may comprise a dissolved lubricating material and/or particulate material, e.g. talc particles, optionally protruding therefrom. Examples of suitable lubricating materials are a surface active agent, a liquid lubricant, a solid lubricant or mixtures thereof, which may be used with or without a polymeric binder. Suitable slipping layer compositions are described, for example, in U.S. Pat. No. 5,587,350, U.S. Pat. No. 5,536,696, U.S. Pat. No. 5,547,914, WO 95/12495, EP-A 775 592 and EP-A 775 595.

Photosensitive Silver Halide

The thermosensitive element used in the recording materials of the present invention may further comprise photosensitive silver halide in catalytic association with the substantially light-insensitive organic silver salt. The photosensitive silver halide used in the present invention may be employed in a range of 0.1 to 100 mol percent; preferably, from 0.2 to 80 mol percent; particularly preferably from 0.3 to 50 mol percent; especially preferably from 0.5 to 35 mol %; and especially from 1 to 12 mol % of substantially light-insensitive organic silver salt.

The silver halide may be any photosensitive silver halide such as silver bromide, silver iodide, silver chloride, silver bromoiodide, silver chlorobromoiodide, silver chlorobromide etc. The silver halide may be in any form which is photosensitive including, but not limited to, cubic, orthorhombic, tabular, tetrahedral, octagonal etc. and may have epitaxial growth of crystals thereon.

The silver halide used in the present invention may be employed without modification. However, it may be chemically sensitized with a chemical sensitizing agent such as a compound containing sulphur, selenium, tellurium etc., or a compound containing gold, platinum, palladium, iron, ruthenium, rhodium or iridium etc., a reducing agent such as a tin halide etc., or a combination thereof. The details of these procedures are described in T. H. James, "The Theory of the Photographic Process", Fourth Edition, Macmillan Publishing Co. Inc., New York (1977), Chapter 5, pages 149 to 169.

Spectral Sensitizer

The thermosensitive element of the recording material, according to the present invention, may contain a spectral sensitizer for the photosensitive silver halide, optionally together with a supersensitizer. The photosensitive silver halide may be spectrally sensitized with various known dyes including cyanine, merocyanine, styryl, hemicyanine, oxonol, hemioxonol and xanthene dyes optionally, particularly in the case of sensitization to infra-red radiation, in the presence of a so-called supersensitizer. Useful cyanine dyes include those having a basic nucleus, such as a thiazoline nucleus, an oxazoline nucleus, a pyrroline nucleus, a pyridine nucleus, an oxazole nucleus, a thiazole nucleus, a selenazole nucleus and an imidazole nucleus. Useful merocyanine dyes which are preferred include those having not only the above described basic nuclei but also acid nuclei, such as a thiohydantoin nucleus, a rhodanine nucleus, an oxazolidinedione nucleus, a thiazolidinedione nucleus, a barbituric acid nucleus, a thiazolinone nucleus, a malononitrile nucleus and a pyrazolone nucleus. Of the above described cyanine and merocyanine dyes, those having imino groups or carboxyl groups are particularly suitable.

Coating

The coating of any layer of the thermographic materials of the present invention may proceed by any coating technique e.g. such as described in Modern Coating and Drying Technology, edited by Edward D. Cohen and Edgar B. Gutoff, (1992) VCH Publishers Inc. 220 East 23rd Street, Suite 909 New York, N.Y. 10010, USA.

Thermographic Printing

Thermographic imaging is carried out by the image-wise application of heat either in analogue fashion by direct exposure through an image of by reflection from an image, or in digital fashion pixel by pixel either by using an infra-red heat source, for example with a Nd-YAG laser or other infra-red laser, or by direct thermal imaging with a thermal head.

When thermal printheads are used, thermal printing image signals are converted into electric pulses and then through a driver circuit selectively transferred to the thermal printhead. This consists of Emicroscopic heat resistor elements, which convert the electrical energy via the Joule effect into heat, which is transferred to the surface of the thermographic material wherein the chemical reaction resulting in the development of a black and white image takes place.

Such thermal printing heads may be used in contact or close proximity with the recording layer. The operating temperature of common thermal printheads is in the range of 300 to 400° C. and the heating time per picture element (pixel) may be less than 1.0 ms, the pressure contact of the thermal printhead with the recording material being e.g. 200–500 g/cm$^2$ to ensure a good transfer of heat.

In order to avoid direct contact of the thermal printing heads with a recording layer not provided with an outermost protective layer, the image-wise heating of the recording layer with said thermal printing heads may proceed through a contacting but removable resin sheet or web wherefrom during said heating no transfer of recording material can take place.

The image signals for modulating the laser beam or current in the micro-resistors of a thermal printhead are obtained directly or from an intermediary storage means, optionally linked to a digital image work station wherein the image information can be processed to satisfy particular needs. Activation of the heating elements can be power-modulated or pulse-length modulated at constant power.

EP-A 654 355 describes a method for making an image by image-wise heating by means of a thermal head having energizable heating elements, wherein the activation of the heating elements is executed duty cycled pulse-wise. When used in thermographic recording operating with thermal printheads said thermographic materials are not suitable for reproducing images with fairly large number of grey levels as is required for continuous tone reproduction. EP-A 622 217 discloses a method for making an image using a direct thermal imaging element producing improvements in continuous tone reproduction. Image-wise heating of the thermographic material can also be carried out using an electrically resistive ribbon incorporated into said material. Image- or pattern-wise heating of the thermographic material may also proceed by means of pixel-wise modulated ultra-sound, using e.g. an ultrasonic pixel printer as described e.g. in U.S. Pat. No. 4,908,631.

Recording Process for Photothermographic Recording Materials

Photothermographic recording materials, according to the present invention, may be exposed with radiation of wavelength between an X-ray wavelength and a 5 microns wavelength with the image either being obtained by pixel-wise exposure with a finely focused light source, such as a CRT light source; a UV, visible or IR wavelength laser, such as a He/Ne-laser or an IR-laser diode, e.g. emitting at 780 nm, 830 nm or 850 nm; or a light emitting diode, for example one emitting at 659 nm; or by direct exposure to the object itself or an image therefrom with appropriate illumination e.g. with UV, visible or IR light.

For the thermal development of image-wise exposed photothermographic recording materials, according to the present invention, any sort of heat source can be used that enables the recording materials to be uniformly heated to the development temperature in a time acceptable for the application concerned e.g. contact heating with for example a heated roller or a thermal head, radiative heating, microwave heating etc.

Industrial Application

Thermographic and photothermographic materials according to the present invention may be used for both the production of transparencies, for example in the medical diagnostic field in which black-imaged transparencies are widely used in inspection techniques operating with a light box, and reflection type prints, for example in the graphics hard copy field. For such applications the support will be transparent or opaque, i.e. having a white light reflecting aspect. Should a transparent base be used, the base may be colourless or coloured, e.g. with a blue colour for medical diagnostic applications.

The following examples and comparative examples illustrate the present invention. The percentages and ratios used in the examples are by weight unless otherwise indicated. The following ingredients were used in preparing the recording materials of COMPARATIVE EXAMPLES 1 to 11 and INVENTION EXAMPLES 1 & 2 in addition to those already mentioned above: the following representative conventional acrylic latexes according to the teaching of WO 97/04355:

| polymer latex number | butyl acrylate [% by wt.] | styrene [% by wt.] | methyl methacrylate [% by wt.] |
|---|---|---|---|
| 1 | 50 | 50 | — |
| 2 | 47 | —53 | |
| 3 | 51 | —49 | |

AgBeh = silver behenate
R01 = ethyl 3,4-dihydroxybenzoate, a reducing agent
R02 = catechol, a reducing agent
T01 = benzo[e] [1,3] oxazine-2,4-dione, a toning agent
K7598 = Type 7598, a calcium-free gelatin from AGFA-GEVAERT GELATINEFABRIEK vorm. KOEPFF & SÖHNE
B79 = BUTVAR ™ B79, a polyvinyl butyral from MONSANTO
S-LEC ™ KW1 = a water-soluble polyvinyl acetal resin from SEKISUI
S-LEC ™ KW3 = a water-soluble polyvinyl acetal resin from SEKISUI

COMPARATIVE EXAMPLES 1 to 9

Thermographic Recording Materials Coated from Aqueous Media Using the Teaching of WO 97/04355 (COMPARATIVE EXAMPLES 1 to 6) or WO 94/16361 (COMPARATIVE EXAMPLES 7 to 9)

Preparation of a Silver Behenate Dispersion 71.5 g of DISPERSE™ AYD W22 (a copolymer consisting of 50% of styrene and 50% of ammonium acrylate together with a non-ionic surfactant from LETICA™ CORP, Rochester, Mich.), 187.5 g of a 10% aqueous solution of surfactant Nr. 5 and 1741 g of deionized water were well mixed and then 500 g of silver behenate powder was added with stirring with a HOMOREX™ stirrer. Stirring was continued for 15 minutes after the addition of the silver behenate and then the resulting dispersion was stored for 24 hours in a refrigerator to allow the foam to dissipate. The dispersion was then stirred for 10 minutes with an ULTRA-TURRAX™ stirrer and then passed through a Type M110F high pressure homogenizer from MICROFLUIDICS™ Corporation at a pressure of 400 bar to obtain the final dispersion.

Preparation of the Silver Behenate Emulsion Layers

In the case of COMPARATIVE EXAMPLE 1 to 6 the coating dispersion was prepared by adding with stirring to the latex dispersion (for type, quantity and concentration see table 1): 26.35 g of the 20% silver behenate dispersion at 40° C., deionized water (for quantity see table 1) and finally a 9.4% aqueous solution of Surfactant Nr. 3 (for quantity see table 1 and for surfactants present in the coating dispersion both from the latex dispersion and added during the preparation of the coating dispersion see table 2).

TABLE 1

| Comparative | polymer latex | | | quantity of | 9.4% solution of Surfactant |
|---|---|---|---|---|---|
| example nr | nr | conc. (%) | quantity [g] | water [g] | Nr. 3 [g] |
| 1 | 1 | 34 | 15.6 | 27.1 | 1.0 |
| 2 | 2 | 36 | 15.1 | 28.6 | 0 |
| 3 | 3 | 20 | 25.7 | 16.9 | 1.0 |
| 4 | 3 | 33 | 15.9 | 26.8 | 1.0 |
| 5 | 3 | 20 | 25.9 | 16.8 | 1.0 |
| 6 | 3 | 21 | 25.3 | 18.1 | 0.25 |

In the cases of COMPARATIVE EXAMPLE 7 the coating dispersion was prepared by adding with stirring to 26.25 g of a 17.6% aqueous solution of K7598 at 40° C.: 26.35 g of the 20% silver behenate dispersion at 40° C., 10.4 g of deionized water and finally 2 g of a 1.4% aqueous solution of Surfactant Nr. 4.

In the cases of COMPARATIVE EXAMPLES 8 & 9 the coating dispersion was prepared by adding with stirring to 26.35 g of the 20% silver behenate dispersion: 26.25 g of a 20% solution of the binder (as indicated for the appropriate COMPARATIVE EXAMPLE in table 2), then 12.4 g of deionized water in the case of COMPARATIVE EXAMPLE 8 and 7.4 g of deionized water and 5 g of ethanol in the case of COMPARATIVE EXAMPLE 9.

The resulting emulsions for COMPARATIVE EXAMPLES 1 to 9 were then coated onto a 175 $\mu$m thick polyethylene terephthalate support to a silver behenate coverage of approximately 7.9 g/m$^2$ after drying for 10 minutes at 50° C.

Overcoating with Organic Reducing Agent-Containing Layer

The silver behenate emulsion layers were overcoated with a solution containing 2.64 g of K7598, 0.65 g of R02 dissolved in 61.05 g of deionized water to which 0.3 g of a 1.4% solution of Surfactant Nr. 4 had been added to a R02 coating weight of 0.65 g/m$^2$ after drying for 10 minutes at 50° C.

Thermographic Printing

During printing of the recording materials of COMPARATIVE EXAMPLES 1 to 9 the print head was separated from the imaging layer by a thin intermediate material contacted with a slipping layer of a separable 5 $\mu$m thick polyethylene terephthalate ribbon coated successively with a subbing layer, heat-resistant layer and said slipping layer (anti-friction layer) giving a ribbon with a total thickness of 6 $\mu$m.

The printer was equipped with a thin film thermal head with a resolution of 300 dpi and was operated with a line time of 19 ms (the line time being the time needed for printing one line). During this line time the print head received constant power. The average printing power, being the total amount of electrical input energy during one line time divided by the line time and by the surface area of the heat-generating resistors was 1.6 mJ/dot being sufficient to obtain maximum optical density in each of the recording materials of COMPARATIVE EXAMPLES 1 to 9.

of 85%. Only a central area of the window 550 mm long by 500 mm wide was used for mounting the test materials to ensure uniform exposure.

The stainless steel light-box used was 650 mm long, 600 mm wide and 120 mm high with an opening 610 mm long and 560 mm wide with a rim 10 mm wide and 5 mm deep round the opening, thereby forming a platform for a 5 mm thick plate of white PVC 630 mm long and 580 mm wide, making the white PVC-plate flush with the top of the light-box and preventing light loss from the light-box other than through the white PVC-plate. This light-box was fitted with 9 PLANILUX™ TLD 36W/54 fluorescent lamps 27 mm in diameter mounted length-wise equidistantly from the two sides, with the lamps positioned equidistantly to one another and the sides over the whole width of the light-box and with the tops of the fluorescent tubes 30 mm below the bottom of the white PVC plate and 35 mm below the materials being tested. The results are summarized in table 2.

TABLE 2

| Comparative Example Nr | AgBeh cover age [g/m$^2$] | POLYMER/ LATEX Nr | Surfactant Nr. | Surfactant [% by wt]* | Fresh $D_{max}/D_{min}$ (blue) | Archivability $\Delta D_{min}$ (blue) after 3d at 35° C./ 80% RH) | Light Box $\Delta D_{min}$ (blue) after 3d at 30° C./ 85% RH) |
|---|---|---|---|---|---|---|---|
| 1 | 7.84 | 1 | 1 + 3 | 4 + 1.8 | 4.75/0.06 | +0.33 | +0.46 |
| 2 | 7.38 | 2 | 1 | 4 | 4.83/0.11 | +0.24 | +0.37 |
| 3 | 7.84 | 3 | 2 + 3 | 1 + 1.8 | 3.85/0.10 | +0.42 | +0.76 |
| 4 | 7.09 | 3 | 1 + 3 | 4 + 1.8 | 4.73/0.11 | +0.36 | +0.38 |
| 5 | 7.55 | 3 | 2 + 3 | 0.5 + 1.8 | 4.56/0.09 | +0.26 | +0.32 |
| 6 | 6.90 | C3 | 2 + 3 | 2 + 0.4 | 4.69/0.09 | +0.37 | +0.44 |
| 7 | 7.38 | K7598 | — | — | 5.23/0.06 | +0.58 | +0.29 |
| 8 | 8.01 | S-LEC ™ KW1 | — | — | 4.03/0.08 | +0.24 | +0.50 |
| 9 | 7.92 | S-LEC ™ KW3 | — | — | 5.12/0.08 | +0.23 | +0.38 |

*with respect to the polymer latex

Image Evaluation

The maximum densities, $D_{max}$, and minimum densities, $D_{min}$, of the prints given in table 2 were measured through a blue filter with a MACBETH™ TR924 densitometer in the grey scale step corresponding to data levels of 64 and 0 respectively and are given in table 2.

Archivability Test

The achivability of prints made with the recording materials of COMPARATIVE EXAMPLES 1 to 9 was evaluated on the basis of the observed changes in minimum density measured through a blue filter using a MACBETH™ TR924 densitometer upon heating the prints at 35° C. in a relative humidity of 80% for 3 days in the dark. The results of these tests are given in table 2.

Light Box Test

The stability of the image background of the prints made with the recording materials of COMPARATIVE EXAMPLES 1 to 9 was evaluated on the basis of the change in minimum (background) density measured through a blue filter using a MACBETH™ TR924 densitometer upon exposure on top of the white PVC window of a specially constructed light-box placed for 3 days in a VOTSCH conditioning cupboard set at 30° C. and a relative humidity The thermographic evaluation of the recording materials of COMPARATIVE EXAMPLES 1 to 6 with conventional acrylic latex polymer latexes and stabilizing surfactants and dispersants according to the teaching of WO 97/04355 showed much poorer archivability and higher light sensitivity than the materials produced following the teaching of the present invention, see the results of INVENTION EXAMPLES 1 & 2.

The thermographic evaluation of the recording materials of COMPARATIVE EXAMPLES 7 to 9 with water-soluble polymers according to the teaching of WO 94/16361 showed much poorer archivability and higher light sensitivity than the materials produced following the teaching of the present invention, see the results of INVENTION EXAMPLES 1 & 2.

Preparation of Dispersions A to F for COMPARATIVE EXAMPLES 10 & 11 and INVENTION EXAMPLES 1 & 2

Dispersion A

To a solution of 30 g of Surfactant Nr. 5 in 40 g of deionized water, was added with stirring with a HOMOREX™ stirrer 30 g of silver behenate powder and the resulting dispersion stirred for a further 30 minutes. The dispersion was then stirred for 15 minutes with an ULTRA-TURRAX™ stirrer and then passed four times through a Type M110F high pressure homogenizer from MICROFLUIDICS™ Corporation at a pressure of 400 to 600 bar to obtain dispersion A containing 30% of silver behenate and 3% of Surfactant Nr 5 in deionized water.

Dispersion B

Solution A was prepared by dissolving 2 g of the reducing agent R01 in 48 g of ethyl acetate with stirring until it was completely dissolved. Solution B was prepared by adding with stirring 20 g of Surfactant Nr. 5 and 8.8 g of K7598 to 69.4 mL of deionized water at 20° C. and was then allowed to swell for 30 minutes before heating to 50° C.

Solution A was then added with vigorous stirring with an ULTRA-TURRAX™ stirrer to solution B at 50° C. and the resulting dispersion was then stirred for a further 5 minutes before passing it through a Type M110F high pressure homogenizer from MICROFLUIDICS™ Corporation at a pressure of 400 to 600 bar. The ethyl acetate was then evaporated off under reduced pressure at 40° C. to produce a dispersion B, an aqueous dispersion containing 2% of R01, 8.8% of gelatin and 2% of Surfactant Nr. 5.

Dispersion C

Dispersion C was prepared by adding 8.8 g of K7598 to 71.6 mL of deionized water at a temperature of 50° C. and was then allowed to swell for 30 minutes before heating to 50° C. To this gelatin solution at 50° C. was added 20 g of T01 with stirring with an ULTRA-TURRAX™ stirrer. The resulting dispersion was then stirred for a further 5 minutes and then circulated through a DYNOMILL™ (a horizontal bead mill from BACHOFEN) to produce aqueous dispersion C containing 20% of T01 and 8.8% of gelatin.

Dispersion D

Solution C was prepared by dissolving 2 g of the reducing agent R01 and 5 g of B79 in 43 g of ethyl acetate with stirring until it was completely dissolved.

Solution D was prepared by adding with stirring 20 g of Surfactant Nr. 5 and 4.4 g of K7598 to 68.8 mL of deionized water at 20° C. and was then allowed to swell for 30 minutes before heating to 50° C.

Solution C was then added with vigorous stirring with an ULTRA-TURRAX™ stirrer to solution D (see preparation of dispersion B) at 50° C. and the resulting dispersion was then stirred for a further 5 minutes before passing it through a Type M110F high pressure homogenizer from MICROFLUIDICS™ Corporation at a pressure of 400 to 600 bar. The ethyl acetate was then evaporated off under reduced pressure at 40° C. to produced a dispersion D, an aqueous dispersion containing 2% of R01, 4.4% of gelatin, 5% of B79 and 2% of Surfactant Nr. 5.

Dispersion E

Dispersion E was prepared as for dispersion D except that the quantities of B79 in solution C and of gelatin in solution B were doubled. The resulting aqueous dispersion E contained 2% of R01, 8.8% of gelatin, 10% of B79 and 2% of Surfactant Nr. 5.

Dispersion F

Solution E was prepared by dissolving 100 g of B79 in 780 g of ethyl acetate. 100 g of silver behenate powder was then added with stirring with an ULTRA-TURRAX™ stirrer to solution E and the resulting dispersion stirred for a further 10 minutes. The predispersion thus produced was then passed twice through a Type M110F high pressure homogenizer from MICROFLUIDICS™ Corporation at a pressure of 600 bar, in which 20 g of R01 was dissolved with stirring to produce a composition F consisting of: 10% B79, 10% of silver behenate and 2% of R01 in ethyl acetate, with a silver behenate particle size of about 500 nm.

Solution G was prepared by dissolving 20 g of Surfactant Nr. 7 in 980 g of a mixture of 93% deionized water and 7% ethyl acetate and then adjusting the pH to 5.5 with an 8.1% aqueous solution of sodium hydroxide. 500 g of Composition F were then added with vigorous stirring with a HOMOREX™ stirrer to solution G and stirring continued for a further 10 minutes. The resulting predispersion was then passed once through a Type M110F high pressure homogenizer from MICROFLUIDIC™ Corporation at a pressure of 600 bar producing a dispersion in ethyl acetate/water (about 31% ethyl acetate and about 61% water). The ethyl acetate was then evaporated off under reduced pressure at 40° C. to produce dispersion F, an aqueous dispersion containing 1.0% of R01, 5% of B79, 5% of silver behenate and 2% of Surfactant Nr. 7.

COMPARATIVE EXAMPLE 10

Thermographic Recording Material Coated from Aqueous Media Using the Teaching of U.S. Pat. No. 4,708,928

The coating dispersion for the recording material of COMPARATIVE EXAMPLE 10 was prepared by adding 23.26 g of deionized water to 2.65 g of K7598 and allowing the gelatin to swell for 30 minutes. The temperature of the resulting composition was then increased to 40° C. and 1.17 g of dispersion C added with stirring once the gelatin had completely dissolved. 62.5 g of dispersion F was then added with vigorous stirring followed by 10.42 g of a 3.7% aqueous solution of formaldehyde to produce a coating dispersion containing 3.75% of AgBeh, 3.3% of gelatin, 3.75% of B79, 0.75% of R01, 0.28% of T01, 1.50% of Surfactant Nr. 7 and 0.46% of formaldehyde.

The coating dispersion was doctor blade-coated with the blade at a setting of 120 $\mu$m onto a subbed 175 $\mu$m thick polyethylene terephthalate (PET) support. After allowing the layer to dry for 4 minutes on the coating table at room temperature, the layer was dried for 12 minutes in a drying cupboard to produce the recording material of COMPARATIVE EXAMPLE 10 with a silver behenate coverage of 3.55 g/m$^2$.

COMPARATIVE EXAMPLE 11

Thermographic Recording Material Coated from Aqueous Media Using Hydrophilic Binders Such as Described in WO 94/16361

The coating dispersion for the recording material of COMPARATIVE EXAMPLE 11 was prepared by adding 52.5 g of dispersion B as small flakes to 17.5 g of dispersion A at 40° C. with stirring until the dispersion was well mixed (after about 10 minutes), then 3.68 g of dispersion C was added as small flakes with stirring. The resulting dispersion was then stirred for 10 minutes before adding 17.5 g of a 3.7% aqueous solution of formaldehyde with stirring and finally 8.82 g of deionized water to produce 100 g of dispersion containing 5.25% of AgBeh, 4.95% of gelatin, 1.05% of R01, 0.74% of T01, 1.58% of Surfactant Nr. 5 and 0.65% of formaldehyde.

The coating dispersion was doctor blade-coated with the blade at a setting of 150 μm onto a subbed 175 μm thick polyethylene terephthalate (PET) support. After allowing the layer to dry for 2 minutes on the coating table at room temperature, the layer was dried for 10 minutes in a drying cupboard at 50° C. to produce the recording material of COMPARATIVE EXAMPLE 11 with a silver behenate coverage of 4.94 g/m$^2$.

INVENTION EXAMPLE 1

The coating dispersion for the recording material of INVENTION EXAMPLE 1 was prepared by adding 52.5 g of dispersion D as small flakes to 17.5 g of dispersion A at 40° C. with stirring until the dispersion was well mixed (after about 10 minutes), then 3.68 g of dispersion C was added as small flakes with stirring. The resulting dispersion was then stirred for 10 minutes before adding 17.5 g of a 3.7% by weight aqueous solution of formaldehyde with stirring and finally 8.82 g of deionized water to produce 100 g of dispersion containing 5.25% of AgBeh, 2.63% of B79, 2.64% of gelatin, 1.05% of R01, 0.74% of T01, 1.58% of Surfactant Nr. 5 and 0.65% of formaldehyde.

The coating dispersion was doctor blade-coated with the blade at a setting of 150 μm onto a subbed 175 μm thick polyethylene terephthalate (PET) support. After allowing the layer to dry for 2 minutes on the coating table at room temperature, the layer was dried for 10 minutes in a drying cupboard at 50° C. to produce the recording material of INVENTION EXAMPLE 1 with a silver behenate coverage of 5.88 g/m$^2$.

INVENTION EXAMPLE 2

The coating dispersion for the recording material of INVENTION EXAMPLE 2 was prepared by adding 52.5 g of dispersion E as small flakes to 17.5 g of dispersion A at 40° C. with stirring until the dispersion was well mixed (after about 10 minutes), then 3.68 g of dispersion C was added as small flakes with stirring. The resulting dispersion was then stirred for 10 minutes before adding 17.5 g of a 3.7% by weight aqueous solution of formaldehyde with stirring and finally 8.82 g of deionized water to produce 100 g of dispersion containing 5.25% of AgBeh, 5.25% of B79, 4.95% of gelatin, 1.05% of R01, 0.74% of T01, 1.58% of Surfactant Nr. 5 and 0.65% of formaldehyde.

The coating dispersion was doctor blade-coated with the blade at a setting of 150 μm onto a subbed 175 μm thick polyethylene terephthalate (PET) support. After allowing the layer to dry for 2 minutes on the coating table at room temperature, the layer was dried for 10 minutes in a drying cupboard at 50° C. to produce the recording material of INVENTION EXAMPLE 2 with a silver behenate coverage of 4.91 g/m$^2$.

Shelf-life Test

The shelf-life of the recording materials of COMPARATIVE EXAMPLES 10 & 11 and INVENTION EXAMPLES 1 & 2 was evaluated on the basis of the observed changes in minimum density measured through a blue filter using a MacBethm™ TR924 densitometer upon heating the thermographic recording materials at 57° C. in a relative humidity of 34% for 3 days in the dark.

Thermographic Evaluation

Thermographic evaluation of the thermographic materials of COMPARATIVE EXAMPLES 10 & 11 and INVENTION EXAMPLES 1 and 2 was carried out as described above for COMPARATIVE EXAMPLES 1 to 9 except for the shelf-life test described above. The results of the thermographic evaluation of the recording materials of COMPARATIVE EXAMPLES 10 & 11 and INVENTION EXAMPLES 1 & 2 are summarized in table 3 below.

TABLE 3

| | AgBeh | discrete particles | | | | Shelf-life $\Delta D_{min}$ (blue) | Archiv-ability $\Delta D_{min}$ (blue) | Light Box $\Delta D_{min}$ (blue) |
|---|---|---|---|---|---|---|---|---|
| | cover-age [g/m$^2$] | polymer with R01 | polymer: R01 ratio | dis-crete ?# | Fresh $D_{max}/D_{min}$ (blue) | after 3d at 57° C./ 34% RH) | after 3d at 35° C./ 80% RH) | after 3d at 30° C./ 85% RH) |
| Compar-ative example Number | | | | | | | | |
| 10 | 3.55 | B79 | 5.00* | yes | —/0.13 | 0.11 | — | 0.12 |
| 11 | 4.94 | K7598 | — | no | 4.26/0.10 | 0.21 | 0.14 | 0.15 |
| Invent-ion Example | | | | | | | | |
| 1 | 5.88 | B79 | 2.50 | yes | 4.23/0.11 | 0.02 | 0.04 | 0.08 |
| 2 | 4.91 | B79 | 5.00 | yes | 4.38/0.11 | 0.04 | 0.03 | 0.09 |

*silver behenate also present in discrete hydrophobic particle

#the discreteness of the particles can be evaluated with TEM- using staining of the polyvinyl butyral phase with $OsO_4$ or $RuO_4$ The recording materials of INVENTION EXAMPLES 1 & 2 coated from aqueous media with R01 dispersed in discrete organic hydrophobic particles exhibited much higher $D_{min}$-stability in shelf-life, archivability and light box tests than the recording material of COMPARATIVE EXAMPLE 10 coated from an aqueous medium but with R01 dispersed together with silver behenate in B79, the same hydrophobic polymer used in the discrete organic hydrophobic particles of INVENTION EXAMPLES 1 & 2, following the teaching of U.S. Pat. No. 4,708,928 and the recording material of COMPARATIVE EXAMPLE 11 also coated from aqueous media but with R01 dispersed in gelatin, a hydrophilic medium following the teaching of WO 94/16361.

Having described in detail preferred embodiments of the current invention, it will now be apparent to those skilled in the art that numerous modifications can be made therein without departing from the scope of the invention as defined in the following claims.

We claim:

1. A process for producing a recording material, including a support and a thermosensitive element, said thermosensitive element comprising a substantially light-insensitive organic silver salt, an organic reducing agent therefor in thermal working relationship therewith, a hydrophobic polymer and a binder, which process comprises the steps of:

producing a dispersion of discrete organic hydrophobic particles consisting essentially of said hydrophobic polymer and said organic reducing agent;

preparing aqueous dispersions or solutions together comprising said substantially light-insensitive organic silver salt, said binder and said discrete organic hydrophobic particles; and coating said dispersions or solutions onto said support to form one or more layers of said thermosensitive element onto said support.

2. The process according to claim 1, wherein said discrete organic hydrophobic particles further comprise a stabilizing agent.

3. The process according to claim 1, wherein said binder is gelatin.

4. The process according to claim 1, wherein said hydrophobic polymer is polyvinyl butyral.

5. The process according to claim 1, wherein said discrete organic hydrophobic particles have a diameter from about 0.1 $\mu$m to about 100 $\mu$m.

6. The process according to claim 1, wherein said silver salt of an organic carboxylic acid is a silver salt of a fatty acid.

7. The process according to claim 1 further comprising the step of adding a protective layer onto said thermosensitive element.

8. A recording material obtained from the process according to claim 1.

9. A process for producing a photothermographic recording material, including a support and a thermosensitive element, said thermosensitive element comprising a substantially light-insensitive organic silver salt, an organic reducing agent therefor in thermal working relationship therewith, photosensitive silver halide in catalytic association with said substantially light-insensitive organic silver salt a hydrophobic polymer and a binder, which process comprises the steps of:

producing a dispersion of discrete organic hydrophobic particles consisting essentially of said hydrophobic polymer and said organic reducing agent;

preparing aqueous dispersions or solutions together comprising said substantially light-insensitive organic silver salt, said photosensitive silver halide, said binder and said discrete organic hydrophobic particles; and coating said dispersions or solutions onto said support to form one or more layers of said thermosensitive element onto said support.

10. The process according to claim 9, wherein said discrete organic hydrophobic particles further comprise a stabilizing agent.

11. The process according to claim 9, wherein said binder is gelatin.

12. The process according to claim 9, wherein said hydrophobic polymer is polyvinyl butyral.

13. The process according to claim 9, wherein said discrete organic hydrophobic particles have a diameter from about 0.1 $\mu$m to about 100 $\mu$m.

14. The process according to claim 9, wherein said silver salt of an organic carboxylic acid is a silver salt of a fatty acid.

15. The process according to claim 9 further comprising the step of adding a protective layer onto said thermosensitive element.

16. A photothermographic recording material obtained from the process according to claim 9.

17. A recording material, comprising:

(A) a support; and (B) a thermosensitive element having one or more layers, said one or more layers comprising:

(i) a substantially light-insensitive organic silver salt;

(ii) a binder; and (iii) discreet organic hydrophobic particles consisting essentially of a hydrophobic polymer and an organic reducing agent entrapped by said hydrophobic polymer.

18. The recording material according to claim 17, wherein said discrete organic hydrophobic particles further comprise a stabilizing agent.

19. The recording material according to claim 17, wherein said binder is gelatin.

20. The recording material according to claim 17, wherein said hydrophobic polymer is polyvinyl butyral.

21. The recording material according to claim 17, wherein said discrete organic hydrophobic particles have a diameter from about 0.1 $\mu$m to about 100 $\mu$m.

22. The recording material according to claim 17, wherein said silver salt of an organic carboxylic acid is a silver salt of a fatty acid.

23. The recording material according to claim 17 further comprising a protective layer on top of said thermosensitive element.

24. The recording material according to claim 17 further comprising a photosensitive silver halide in catalytic association with said substantially light-insensitive organic silver salt.

* * * * *

UNITED STATES PATENT AND TRADEMARK OFFICE

CERTIFICATE OF CORRECTION

PATENT NO. : 6,030,765
DATED : February 29, 2000
INVENTOR(S) : Leenders et al.

It is certified that error appears in the above-identified patent and that said Letters Patent is hereby corrected as shown below:

Column 11, Table: Under heading "styrene", "53" and "49"should be moved to the corresponding positions under heading "methyl methacrylate".

Signed and Sealed this

Fifteenth Day of May, 2001

*Attest:*

Nicholas P. Godici

NICHOLAS P. GODICI

*Attesting Officer*

*Acting Director of the United States Patent and Trademark Office*